US006850008B2

(12) United States Patent
Clark

(10) Patent No.: US 6,850,008 B2
(45) Date of Patent: Feb. 1, 2005

(54) GAS-FILLED ARC DISCHARGE LAMP AND A METHOD OF MAKING THEREOF

(75) Inventor: David L. Clark, Horseheads, NY (US)

(73) Assignee: Imaging & Sensing Technology Corporation, Horseheads, NY (US)

( * ) Notice: Subject to any disclaimer, the term of this patent is extended or adjusted under 35 U.S.C. 154(b) by 63 days.

(21) Appl. No.: 10/073,439

(22) Filed: Feb. 8, 2002

(65) Prior Publication Data

US 2002/0105271 A1 Aug. 8, 2002

Related U.S. Application Data

(60) Provisional application No. 60/267,335, filed on Feb. 8, 2001.

(51) Int. Cl.[7] ..... H01J 17/04

(52) U.S. Cl. ..... 313/613; 313/239; 313/45; 313/292

(58) Field of Search ..... 313/622, 580, 313/631, 634, 46, 344, 345, 613, 616, 619, 326, 589, 239, 45, 292

(56) References Cited

U.S. PATENT DOCUMENTS 4,366,408 A 12/1982 Cooper et al.
5,552,669 A * 9/1996 Ikedo et al. ..... 313/613
5,587,625 A 12/1996 Ikedo et al.
5,619,101 A 4/1997 Ikedo et al.
5,633,563 A 5/1997 Ikedo et al.
5,646,487 A * 7/1997 Ikedo et al. ..... 315/94
5,684,363 A 11/1997 Ikedo et al.
5,698,945 A 12/1997 Ikedo et al.
5,864,209 A 1/1999 Clark
5,972,469 A 10/1999 Curtis
5,977,727 A 11/1999 Dunbar
6,078,132 A 6/2000 Davenport

FOREIGN PATENT DOCUMENTS

GB 2352869 * 2/2001

* cited by examiner

*Primary Examiner*—Ashok Patel
(74) *Attorney, Agent, or Firm*—Nixon Peabody LLP

(57) ABSTRACT

A gas discharge lamp having a translucent envelope enclosing a light emitting assembly that includes a baffle and an anode separated by one or more spacers made of an electrically insulating material such as ceramic, which are oriented towards a heated cathode to receive electrons emitted therefrom. Each spacer has a front surface, a rear surface, a top surface and a bottom surface including a transverse cavity formed between the front and rear surfaces to permit electrons to flow through. The cavity extends from a first through-hole in the front surface to a second through-hole in the rear surface of the spacer. Further, the cavity includes a gap for allowing conductive materials that may sputter or evaporate from the anode or the baffle to escape from the cavity to prevent short circuiting between the anode and the baffle.

23 Claims, 8 Drawing Sheets

GAS-FILLED ARC DISCHARGE LAMP AND A METHOD OF MAKING THEREOF

This application claims the benefit of U.S. Provisional Application Ser. No. 60/267,335 filed on Feb. 8, 2001, which is herein incorporated by reference in its entirety.

FIELD OF THE INVENTION

This invention relates generally to gas-filled arc discharge lamps and, more particularly, to a gas discharge lamp including one or more insulating members interposed between an anode and a baffle and forming a gap for trapping accumulated conductive materials.

BACKGROUND OF THE INVENTION

Gas-filled arc discharge lamps are used as ambient room lighting devices, indicators, neon signs, tanning bulbs, photographic electronic flashes and A/V projector devices. Because gas discharge lamps generally last longer than conventional incandescent lamps and can generate ultraviolet light, they are particularly well-suited for industrial use, such as for spectroscopy and materials analysis. In industrial settings it is desirable for these lamps to operate for at least 2000 hours while maintaining their light output intensity level at a minimum of 50% of their initial intensity.

Examples of typical gas discharge lamps include U.S. Pat. Nos. 4,366,408; 5,522,669; 5,864,209; 5,972,469; and 6,078,132, all of which are hereby incorporated by reference in their entirety. Some gas discharge lamps cannot satisfy the above-noted industrial performance requirements. A gas discharge lamp, frequently referred to as a Long Life ("LL") lamp, has been successfully designed to satisfy at least some of these requirements. While these LL lamps often perform well enough to meet the performance requirements, their design has given rise to other problems, such as short circuits occurring because of an accumulation of deposited conductive material caused by sputtering in the light emitting portion, undesirable arcing, "noisy" or unstable light output and poor overall structural integrity.

Referring to FIGS. 1–2, an exemplary light emitting portion 10 of a conventional arc gas discharge lamp is shown. The light emitting portion 10 includes an anode 12, focusing electrode or baffle 14, an insulator 16 arranged within an opening 18 of a support 19, all of which are oriented towards a cathode filament 20 and encased within a first cover 22 and a second cover 24. As shown in FIG. 2, conductive material 26 accumulates on the interior surface of the cavity 28 in the insulator 16 as a result of sputtering caused by repeatedly striking the anode 12 with thermoelectrons. This accumulation of material 26 forms a conductive path between the anode 12 and the baffle 14 leading to short circuiting and the other undesirable effects mentioned above.

SUMMARY OF THE INVENTION

A lamp in accordance with one embodiment of the present invention includes an anode oriented substantially towards a cathode in an envelope, a baffle in the envelope located between the anode and the cathode, the baffle having an aperture, an electrical insulator having a first surface connected to a first surface of the baffle and a second surface of the electrical insulator connected to a first surface of the anode, the electrical insulator having a transverse cavity extending from a first through-hole in the first surface of the electrical insulator to a second through-hole in the second surface of the electrical insulator, the electrical insulator having a gap in the transverse cavity.

A lamp in accordance with another embodiment of the present invention includes an anode oriented substantially towards a cathode in an envelope, a baffle in the envelope located between the anode and the cathode, the baffle having an aperture, a first electrical insulator having a first surface connected to a first surface of the baffle, the first electrical insulator having a first transverse cavity extending from a first through-hole in the first surface of the first electrical insulator to a second through-hole in a second surface of the first electrical insulator, a second electrical insulator having a first surface connected to the second surface of the first electrical insulator and a second surface of the second electrical insulator connected to a first surface of the anode, the second electrical insulator having a second transverse cavity extending from a third through-hole in the first surface of the second electrical insulator to a fourth through-hole in the second surface of the second electrical insulator, and a gap formed in at least one of the first transverse cavity adjacent the second through-hole and the second transverse cavity adjacent the third through hole.

A light emitting assembly in accordance with another embodiment of the present invention includes an electrical insulator, a transverse cavity in the electrical insulator, the transverse cavity extending from a first through-hole in a first surface of the electrical insulator to a second through-hole in a second surface of the electrical insulator, and a gap in the transverse cavity of the electrical insulator.

A light emitting assembly in accordance with another embodiment of the present invention includes a first electrical insulator, a second electrical insulator, a first transverse cavity in the first electrical insulator, the first transverse cavity extending from a first through-hole in a first surface of the first electrical insulator to a second through-hole in a second surface of the first electrical insulator, a second transverse cavity in the second electrical insulator, the second transverse cavity extending from a third through-hole in the first surface of the second electrical insulator to a fourth through-hole in a second surface of the second electrical insulator, and a gap formed in at least one of the first transverse cavity adjacent the second through-hole and the second transverse cavity adjacent the third through hole.

A method of manufacturing a light emitting assembly in accordance with another embodiment of the present invention includes fonring a transverse cavity in an electrical insulator from a first through-hole in a first surface of the electrical insulator to a second through-hole in a second surface of the electrical insulator, and forming a gap in the transverse cavity of the electrical insulator.

A method of manufacturing a light emitting assembly in accordance with another embodiment of the present invention includes forming a first transverse cavity from a first through-hole in a first surface of a first electrical insulator to a second through-hole in a second surface of the first electrical insulator, forming a second transverse cavity from a third through-hole in the first surface of a second electrical insulator to a fourth through-hole in a second surface of the second electrical insulator, and forming a gap in at least one of the first transverse cavity adjacent the second through-hole and the second transverse cavity adjacent the third through hole.

The present invention provides a number of advantages over conventional designs including substantially preventing short circuits from occurring thereby reducing equipotential field structure fluctuations to reduce "noisy" or unstable light output and substantially preventing undesirable arcing and current leakage. Additionally, the present invention provides a lamp with efficient beat dissipation and increased structural integrity over conventional designs. Further, the present invention provides gas discharge lamps that meet or exceed industrial operational and light output intensity maintenance performance requirements.

DETAILED DESCRIPTION OF THE INVENTION

Figure 1:
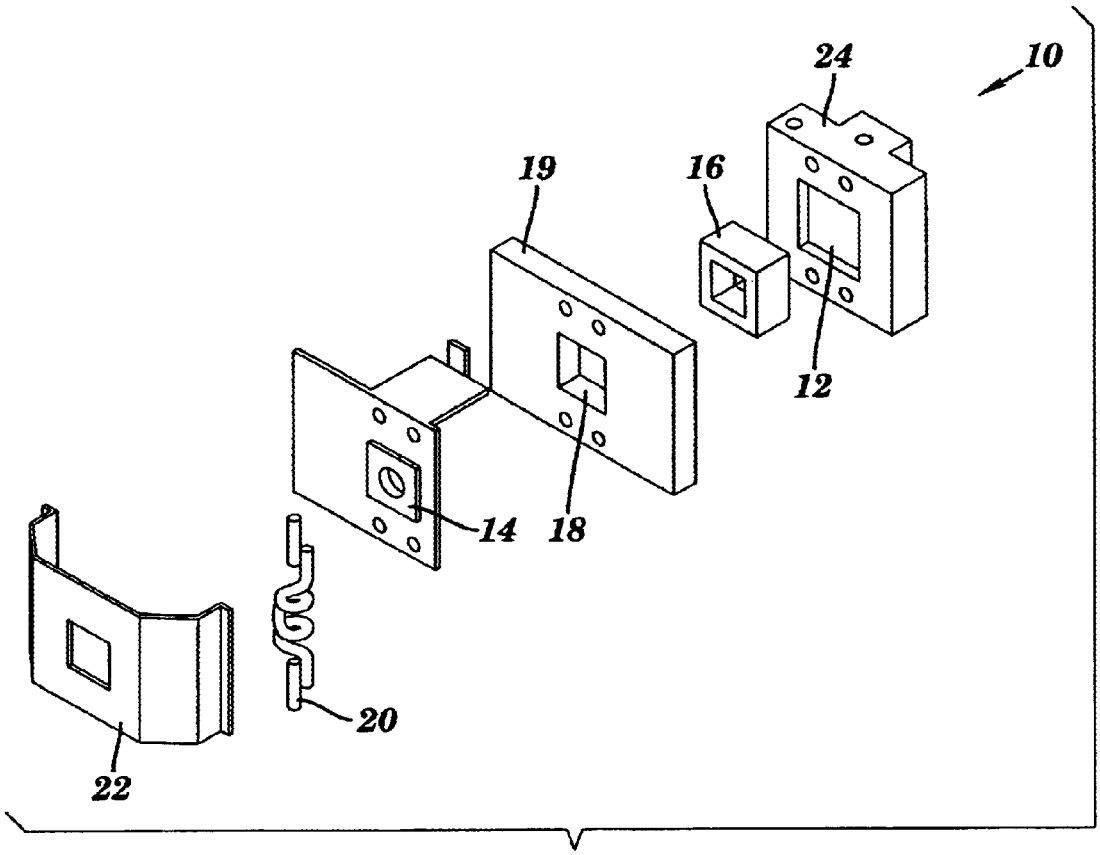
FIG. 1 PRIOR ART
FIG. 1 is an exploded, perspective view of a light emitting portion used in a conventional arc gas discharge lamp.
Figure 2:
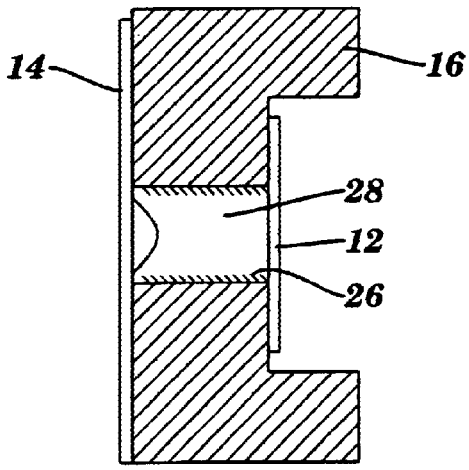
FIG. 2 PRIOR ART
FIG. 2 is an enlarged, cross-sectional, side view of an anode portion of the conventional arc gas discharge lamp illustrated in FIG. 1.

A gas discharge lamp 30 in accordance with an embodiment of the present invention is illustrated in FIGS. 3–7. In this embodiment, the lamp 30 includes a light emitting assembly 40(1) having a spacer 46 with a gap 80 and arranged in between an anode 42 and a baffle 44 within an anode assembly 47, which are all arranged within an envelope 32. The lamp 30 provides a number of advantages over conventional gas discharge lighting devices including substantially reducing short circuits from occurring thereby reducing equipotential field structure fluctuations within the light emitting assembly 40(1) to reduce "noisy" or unstable light output during operation of the lamp 30. The lamp 30 also substantially prevents undesirable arcing and current leakage, efficient heat dissipation and increased structural integrity of the light emitting assembly 40(1) over conventional designs. Further, the light emitting assembly 40(1) enables lamp 30 to meet or exceed industrial performance requirements including operational duration (i.e., at least 2000 hours) and light output intensity maintenance (i.e., at least 50% of initial output intensity).

In embodiments of the present invention, the terms "horizontal,""vertical," "left," "right," "up," "down," "top," "bottom," "front," "side," as well as adjectival and adverbial derivatives thereof (e.g., "horizontally," "upwardly," etc.), refer to the orientation of the illustrated structure as the particular drawing figure faces the reader. Similarly, the terms "inwardly" and "outwardly" generally refer to the orientation of a surface relative to its axis of elongation, or axis of rotation, as appropriate. These directional terms are included for ease of discussion only and are not intended to be limiting in any manner. The particular orientation of the present invention can vary from the embodiments shown and described herein, which may require corresponding change of the directional terms. The claims are intended to cover those embodiments as well.

Figure 3:
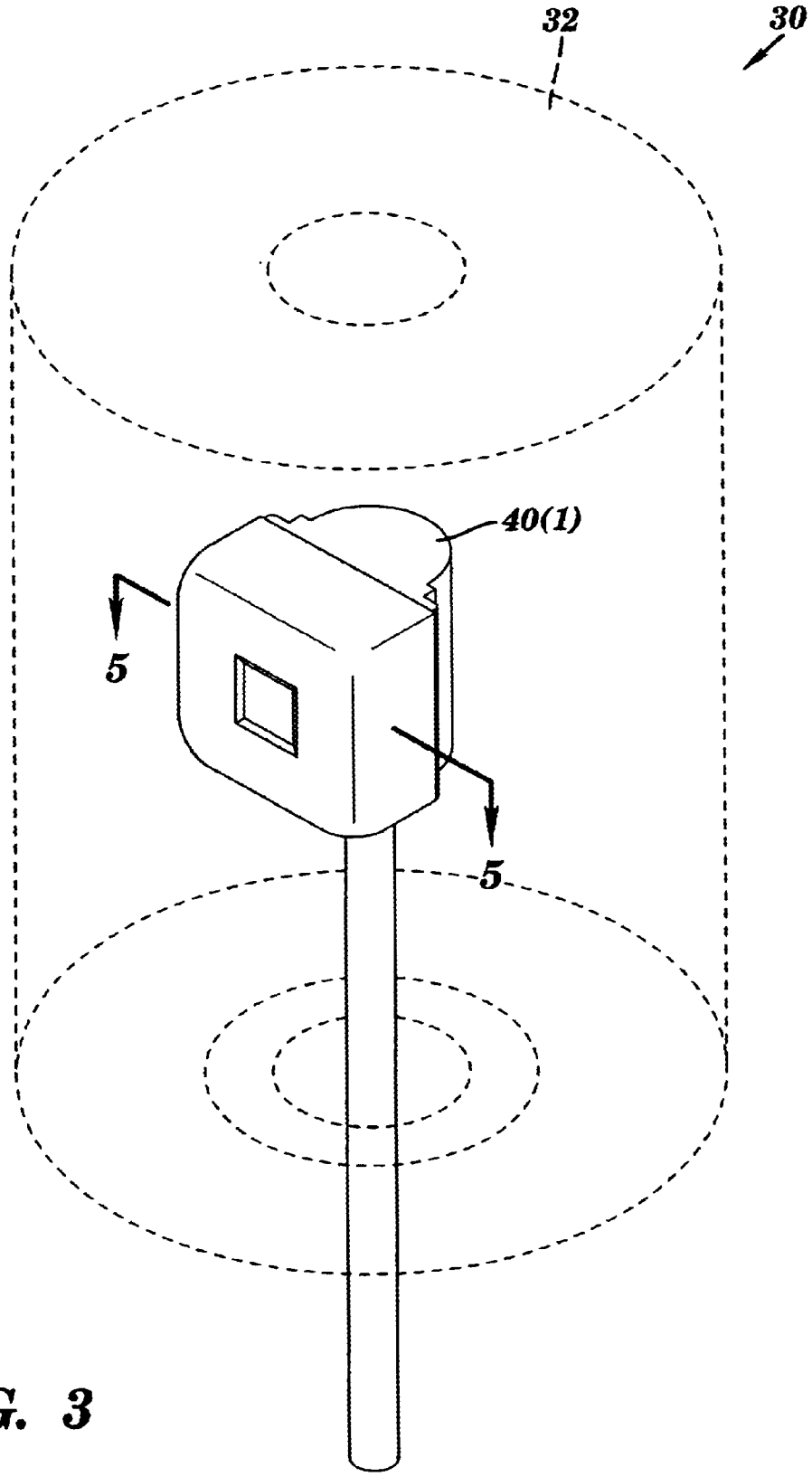
FIG. 3 is a cross-sectional perspective view of a gas discharge lamp in accordance with an embodiment of the present invention.

Referring more specifically to FIG. 3, the envelope 32 substantially encloses a light emitting assembly 40(1), which will be described in further detail herein. The envelope 32 provides a substantially hermetic seal to hold in one or more gases such as deuterium, hydrogen, or a mixture of both, from escaping the lamp 30, although other gases (e.g., krypton, argon, krypton, xenon, etc.) and gas mixtures capable of being ionized may be used. The envelope 32 may be made of glass, although other translucent materials such as quartz may be used. Further, the envelope 32 may have a phosphorous coating on its interior surface facing the light emitting assembly 40(1) for converting radiation emitted from the assembly 40 into visible light.

Figure 4:
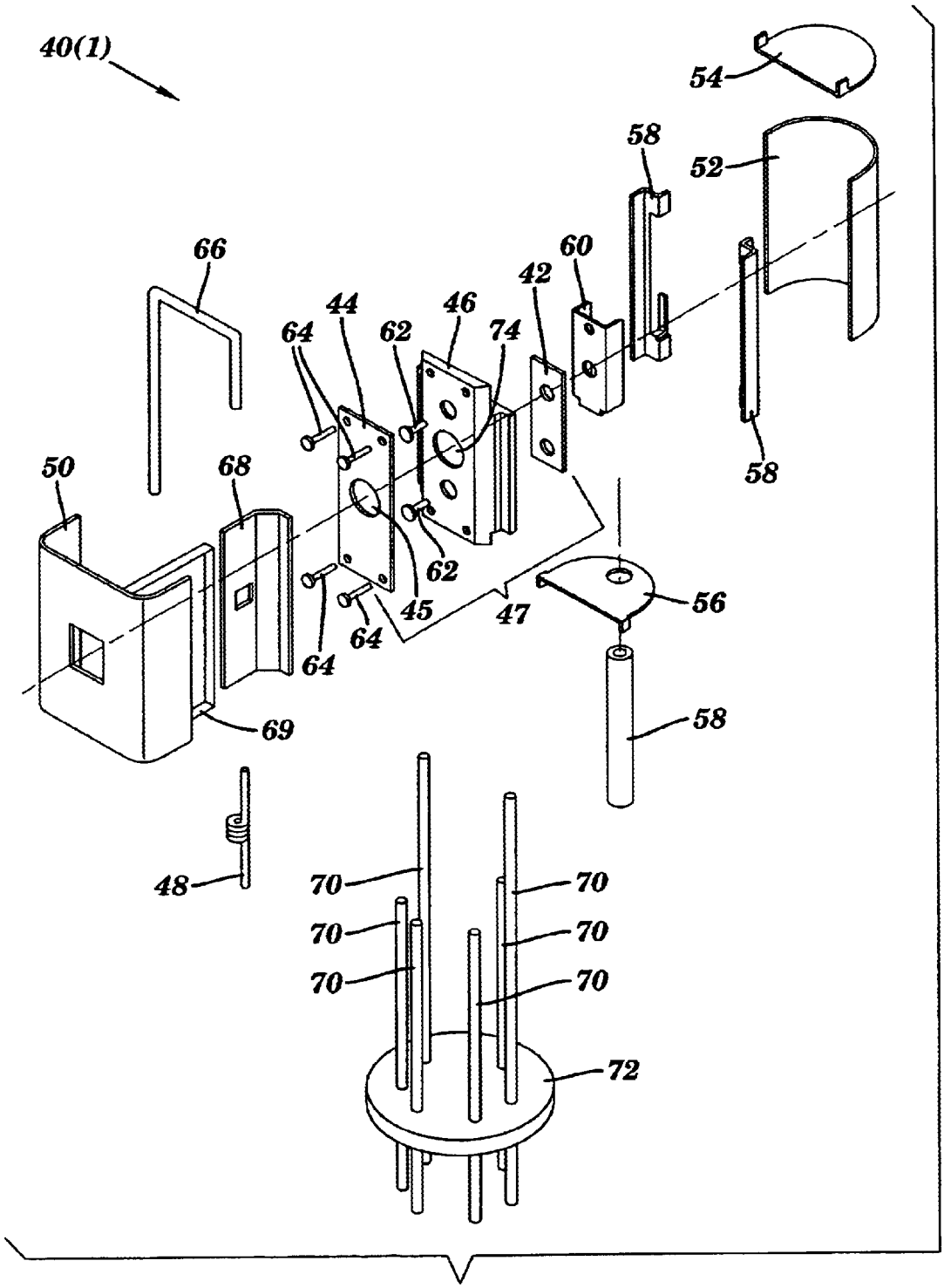
FIG. 4 is an exploded, perspective view of a light emitting assembly of the gas discharge lamp in FIG. 3 according to an embodiment of the present invention.
Figure 5:
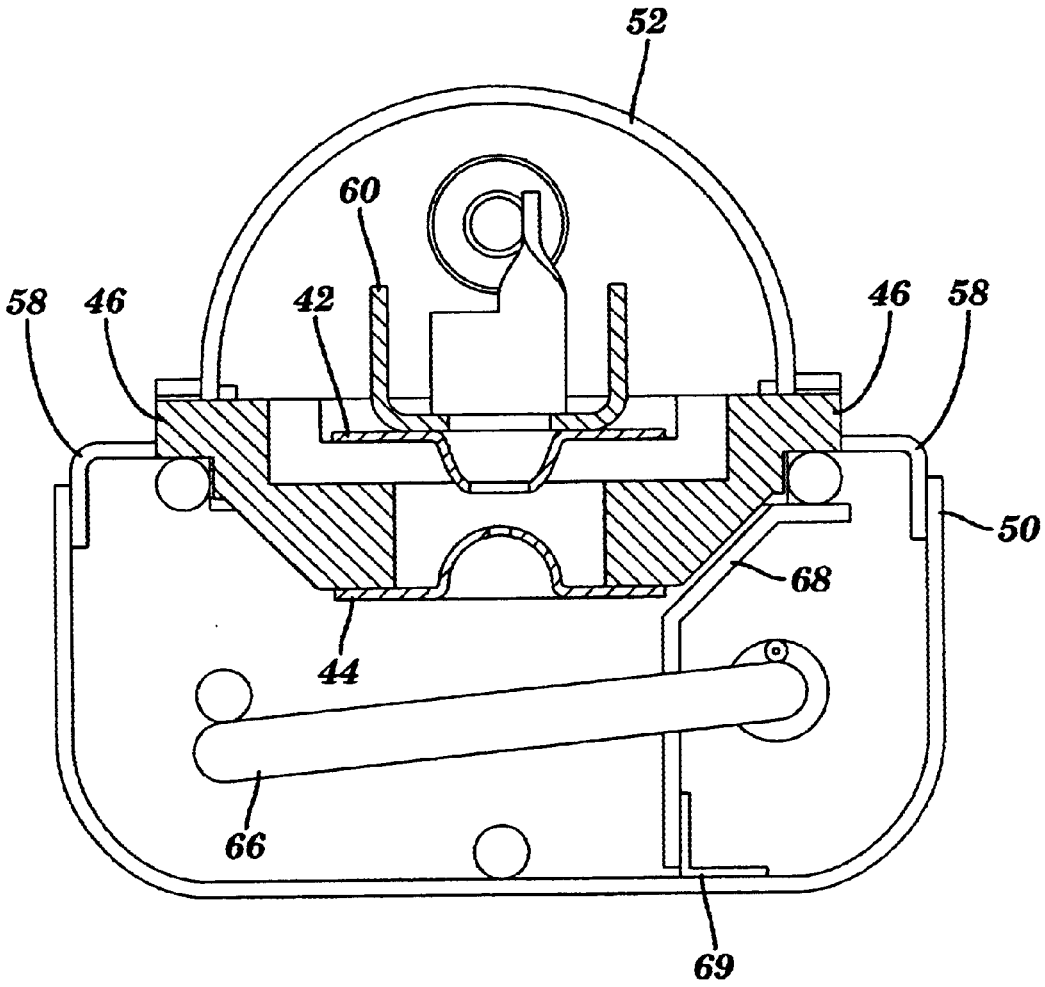
FIG. 5 is a cross-sectional top view taken along the line 5—5 of the light emitting assembly in FIG. 3.

Referring to FIGS. 4–5, the light emitting assembly 40(1) will now be described in accordance with another embodiment of the present invention. The assembly 40(1) includes an anode 42, baffle 44 and spacer 46 (i.e., anode assembly 47), which are directly opposed to cathode 48, although other orientations of the anode assembly 47 with respect to the cathode 48 may be used. Anode 42 is connected to the rear surface of the spacer 46 by anode dowels 62, although other connection means may be used. An anode radiator 60 may be connected to the rear surface of the anode 42 using resistance welds, adhesive or other connection means such as dowels or screws. In this embodiment, the anode 42 is made of Molybdenum, and the radiator 60 is made of Nickel and may have a thickness of about 0.015 with respect to the thickness between its front surface facing the rear surface of the anode 42 and its rear surface facing the rear supports 58, although other materials and thicknesses may be used. The anode radiator 60 helps dissipate heat that is generated by the anode 42 during operation of the lamp 30 by increasing the surface area contact of the anode 42.

The baffle 44 is connected to the front surface of spacer 46 by baffle dowels 64, although other connection means may be used such as rivets, screws or adhesive. Further, the baffle 44 has an aperture 45 for converging and passing thermoelectrons emitted from the cathode 48 towards the anode 42. In this embodiment, the baffle 44 is made of Molybdenum, and baffle dowels 64 are made of Nickel, although other materials may be used.

Spacer 46 comprises an electrically insulating material such as ceramic, although other insulating materials may be used. Spacer 46 has a front surface facing the rear surface of the baffle 44 and an opposing rear surface facing the front surface of the anode 42. Further, the spacer 46 has a top surface, an opposing bottom surface, and a transverse cavity 74 formed between the front surface and the rear surface, which is substantially concentric with respect to the aperture 45 in the baffle 44 to enable electrons to pass through.

The cathode 48 is connected to the cathode lead extension 66, which in turn is connected to one of the leads 70 for receiving an electrical current to cause the cathode 48 to emit thermoelectrons. In this embodiment, the cathode 48 is made of tungsten, although other materials may be used. Further, the cathode 48 is substantially coated with an electron emitting material such as barium oxide for emitting thermoelectrons when an electrical current is provided during operation of the lamp 30, although any alkaline earth oxide material or combination thereof may be used for the coating. In this embodiment, the cathode 48 is directly heated to facilitate electron emission.

The light emitting assembly 40(1) includes a window shield 50 having an aperture therein to allow the radiation generated by the assembly 40(1) to radiate into the envelope 32 of lamp 30 for generating light. A cathode cover 68 is connected to the window shield 50 at its front surface facing the window shield 50 by strip 69 to provide a shield for the cathode 48 for suppressing undesirable arcing and increasing the structural integrity of the light emitting assembly 40(1). Further, the cover 68 is connected at its rear surface to the rear supports 58 for substantially enclosing the components of the light emitting assembly 40(1). Additionally, the rear supports 58 are connected to a can shield 52 having a top cover 54 and a bottom cover 56 to provide a shield for the anode 42 for suppressing undesirable arcing and current leakage. In this embodiment, the window shield 50, can shield 52, top cover 54, bottom cover 56, rear supports 58, cathode cover 68 and strip 69 are made of Nickel and may be connected together by welding, although other materials and connection means may be used. Furthermore, a ceramic insulator 58 may be used to cover one of the leads 70 leading into the anode assembly 47 to provide additional shielding. Moreover, a lead stem 72 made of glass may be used as a base for the leads 70 to pass through and to seal the bottom of the assembly 40(1) and to provide additional structural integrity.

Figure 6:
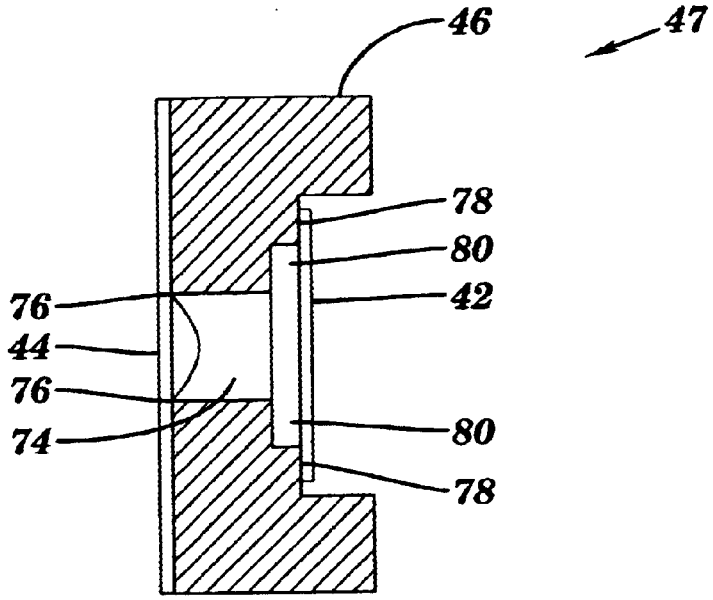
FIG. 6 is an enlarged cross-sectional, side view of an anode assembly of the light emitting assembly in accordance with another embodiment of the present invention.
Figure 7:
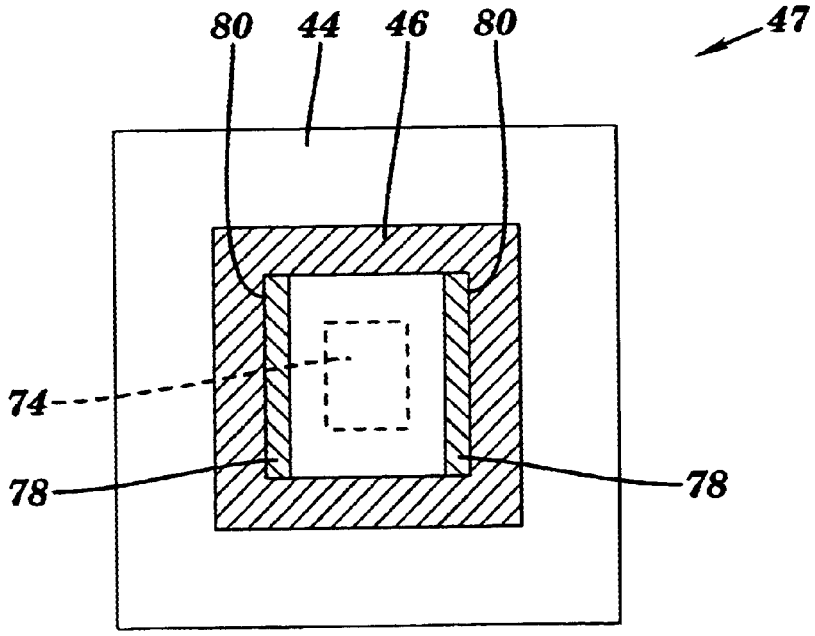
FIG. 7 is a cross-sectional, front view of the anode assembly in FIG. 6.

Referring to FIGS. 6–7, the anode assembly 47 will now be described in further detail in accordance with another embodiment of the present invention. Spacer 46 has a front surface facing the baffle 44 and a rear surface facing the anode 42. Moreover, the spacer 46 has a top surface and a bottom surface that are substantially parallel with respect to each other and perpendicular with respect to the front and rear surfaces of the spacer 46. The cavity 74 extends from first through-hole 76 in its front surface to a second through-hole 78 in the rear surface of the spacer 46. Further, the portion of the cavity 74 adjacent the second through-hole 78 is substantially larger than the remaining portion of the cavity 74 to form a gap 80. The gap 80 extends substantially around the cavity 74, although the gap 80 may have other configurations, such as being intermittently spaced around cavity 74. Although the gap 80 is shown adjacent to the second through-hole 78, the gap 80 may be located elsewhere, such as adjacent the first through-hole 76 or spaced in from the first and second through-holes 76 and 78 in spacer 46.

The gap 80 allows conductive materials that may sputter or evaporate from the anode 42 or baffle 44 as they are stricken by thermoelectrons emitted from the cathode 48 to escape the cavity 74 through the gap 80. This way, contiguous conductive paths are substantially reduced along the interior surfaces of the cavity 74 in the spacer 46 between the anode 42 and the baffle 44 since the gap areas 80 provide changes in the elevation of the internal horizontal surfaces of the cavity 74 and discontinuous surfaces between the anode 42 and baffle 44, thereby substantially preventing short circuiting.

The operation of the lamp 30 will now be described in accordance with another embodiment of the present invention with reference to FIGS. 3–7. Electrical current is applied to the cathode 48 to preheat the cathode 48 to a temperature of about 600–800° C. or for a period of about 10–30 seconds. When the cathode 48 is sufficiently heated to be ready for arc discharge, a trigger voltage of about 250V to 600V is applied between the anode 42 and the cathode 48 to initiate discharge. Thermoelectrons (not illustrated) emitted from the cathode 48 interact with the fill gas to form an "arc ball" and pass through the aperture in the baffle 44, which focuses the arc ball so the thermoelectrons pass through the cavity 74 of the spacer 74 where they converge upon the anode 42. The radiation (i.e., light) generated by the arc ball projects out of the light emitting assembly 40(1) through the aperture in the window shield 50 where the radiation projects out of the lamp 30 through the envelope 32.

Figure 8:
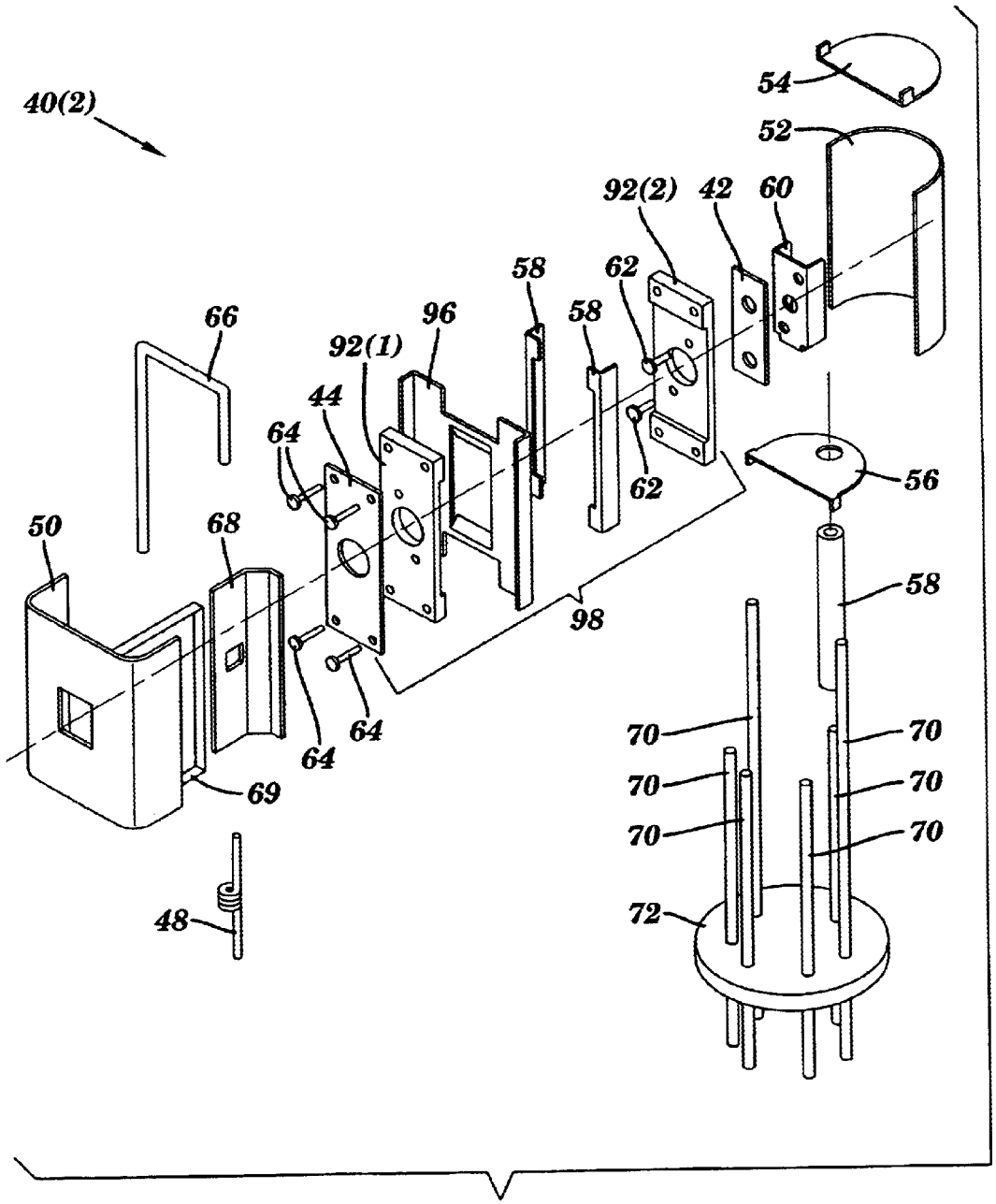
FIG. 8 is an exploded, perspective view of a light emitting assembly of a gas discharge lamp according to another embodiment of the present invention.
Figure 9:
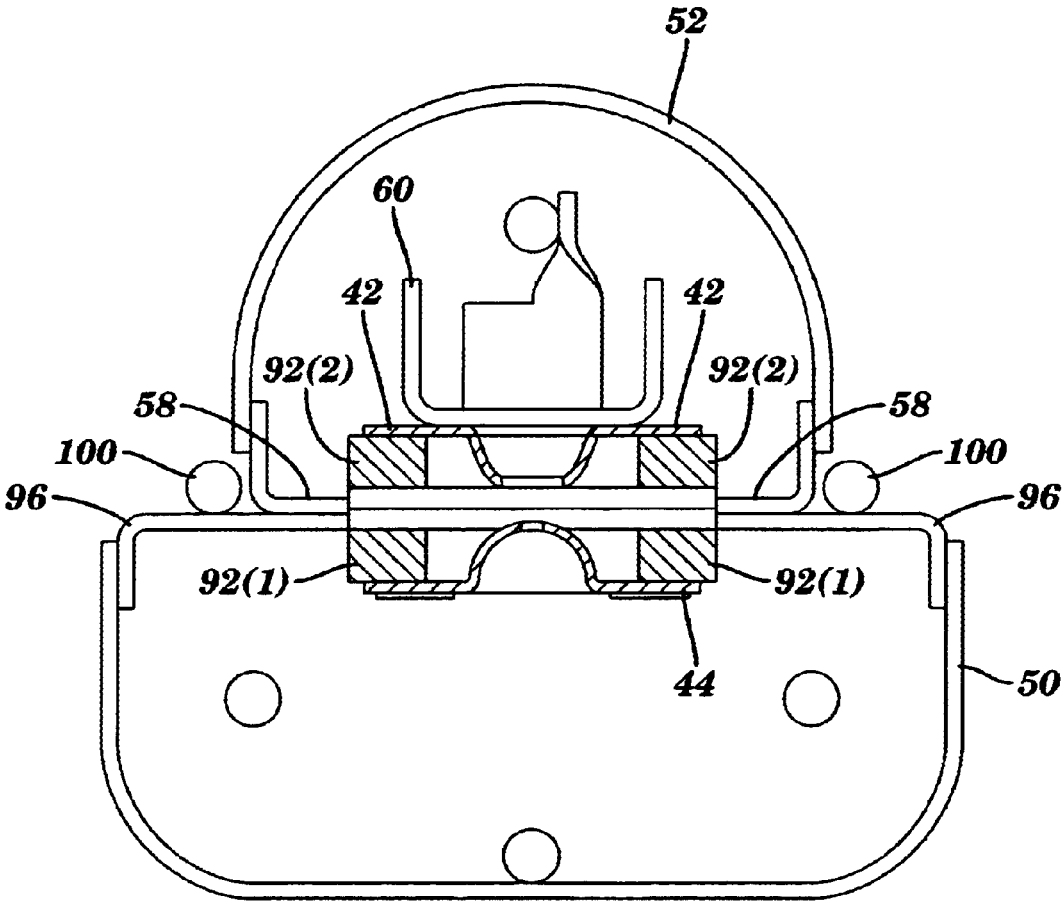
FIG. 9 is a cross-sectional top view of the light emitting assembly in FIG. 8.

Referring to FIGS. 8–9, an alternative embodiment of the lamp 30 will now be described. Like reference numbers in FIGS. 8–9 are identical to those in and described with reference to FIGS. 3–7, except in this embodiment, lamp 30 includes light emitting assembly 40(2) substituted for light emitting assembly 40(1). Further, light emitting assembly 40(2) is the same as light emitting assembly 40(1), but includes split spacers 92(1)–92(2) instead of spacer 46 and a spacer support 96 as described further herein below. Still further, the split spacers 92(1)–92(2) are the same as the spacer 46 described above in connection with the light emitting assembly 40(1) except as described further herein.

In this embodiment, the baffle 44 is connected to the front surface of the split spacer 92(1) by the baffle dowels 64, although other connection means may be used. The spacer support 96 is arranged in the light emitting assembly 40(2) between the split spacers 92(1)–92(2) to form the split spacer assembly 98. The baffle dowels 64 also help connect the split spacers 92(1)–92(2) together. The spacer support 96 is made of Nickel having a thickness of about 0.015 with respect to its front and rear surfaces, although the support 96 may be made of a number of other materials and have other thicknesses. Further, the support 96 is electrically isolated from the anode 42 and the baffle 44. The selected material and thickness of the support 96 improves overall heat dissipation and increases the structural integrity of the light emitting assembly 40(2).

Further, the spacer support 96 and the rear supports 58 are connected to the window shield 50, can shield 52, top cover 54, bottom cover 56, cathode cover 68 and strip 69 using any of the connection means described above in connection with one or more embodiments. This configuration leads to increasing the structural integrity of the light emitting assembly 40(2). Anode 42 is connected to the rear surface of the split spacer 92(2) by anode dowels 62, although other connection means may be used. The remaining portions of the light emitting assembly 40(2) are assembled in the same manner described above in connection with light emitting assembly 40(1). Further, the rear supports 58 may be welded to the Kovar leads 100 to further increase the structural integrity of the light emitting assembly 40(2), although any of the connection means described above may be used.

Figure 10:
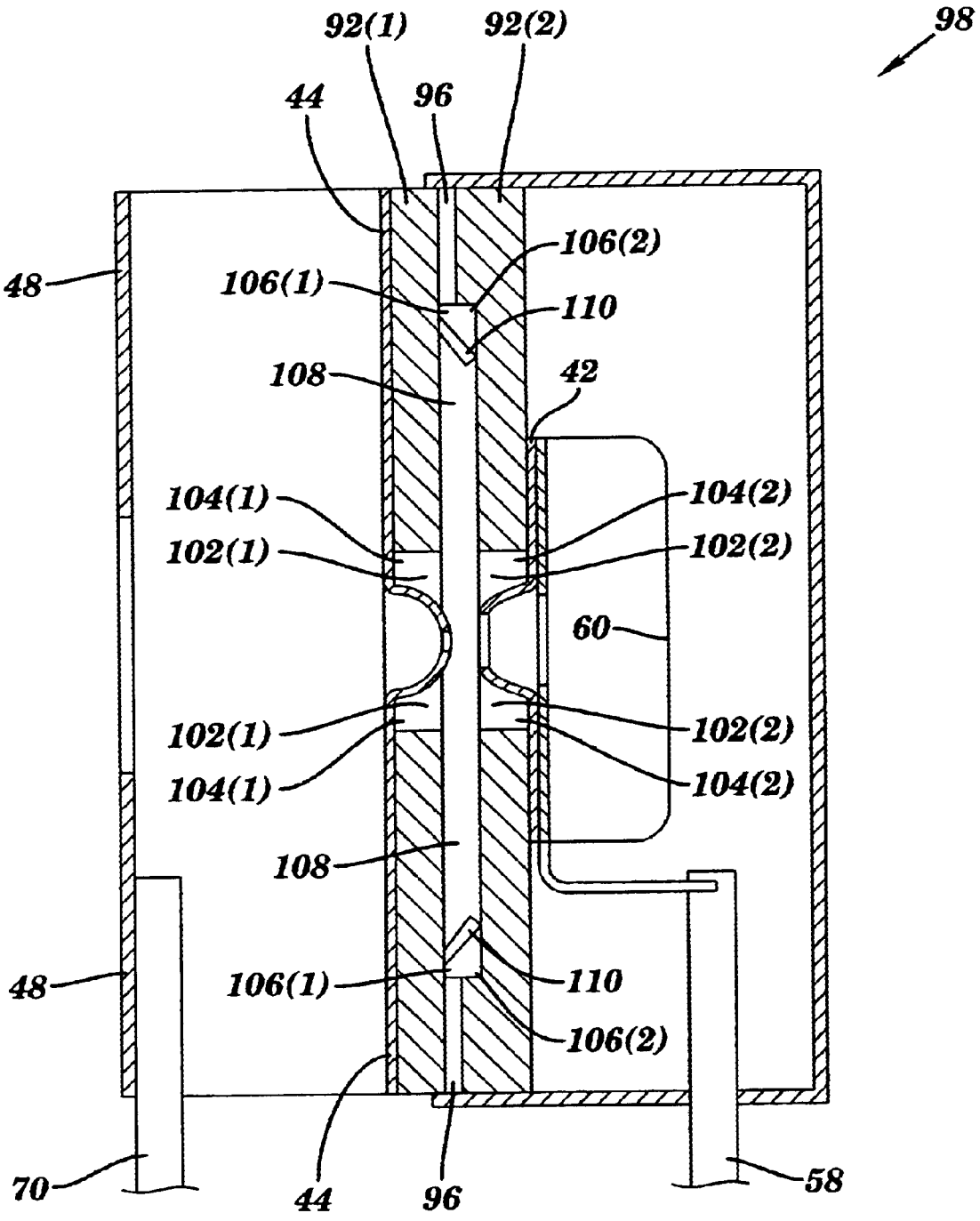
FIG. 10 is an enlarged partial cross-sectional side view of the light emitting assembly in FIG. 8 illustrating a split spacer anode assembly according to another embodiment of the present invention.

Referring to FIG. 10, the split spacer anode assembly 98 will now be described in further detail in accordance with another embodiment of the present invention. Split spacer 92(1) has a front surface facing the rear surface of the baffle 44 and has a rear surface facing the front surface of split spacer 92(2). Moreover, the split spacer 92(1) has a top surface and a bottom surface that are substantially parallel with respect to each other and perpendicular with respect to the front and rear surfaces of the spacer 92(1). The spacer 92(1) includes a cavity 102(1) that extends from a first through-hole 104(1) in its front surface to a second through-hole 106(1) in the rear surface of the spacer 92(1). Further, the portion of the cavity 102(1) adjacent the second through-hole 106(1) is substantially larger than the remaining portion of the cavity 102(1).

Split spacer 92(2) has a front surface facing the rear surface of the spacer 92(1) and has a rear surface facing the front surface of the anode 42. Moreover, the split spacer 92(2) has a top surface and a bottom surface that are substantially parallel with respect to each other and perpendicular with respect to the front and rear surfaces of the spacer 92(2). The spacer 92(2) includes a cavity 102(2) that extends from a first through-hole 104(2) in its rear surface facing the anode 42 to a second through-hole 106(2) in the front surface of the spacer 92(2) facing the rear surface of the spacer 92(1). Further, the portion of the cavity 102(2) at the first through-hole 106(2) is substantially larger than the remaining portion of the cavity 102(2).

The spacer 92(1) is connected to the spacer 92(2) using any of the connection means described above in connection with one or more embodiments. As shown, the portion of the cavity 102(1) adjacent the second through-hole 106(1) in the rear surface of the spacer 92(1) forms a gap 108 when joined to the portion of the cavity 102(2) adjacent the first through-hole 106(2) in the front surface of spacer 92(2). The gap 108 extends substantially around cavities 102(1) and 102(2). Although the gap 108 may have other configurations, such as being intermittently spaced around cavities 102(1) and 102(2). The gap 108 allows conductive materials that may sputter or evaporate from the anode 42 or the baffle 44 as they are stricken by thermoelectrons emitted from the cathode 48 to escape cavities 102(1)–102(2) through the gap 108, and provides discontinuous surfaces between the anode 42 and the baffle 44 thereby substantially preventing short circuiting and substantially reducing current leakage. Although in this particular embodiment, gap 108 is formed in both cavities 102(1) and 102(2), other locations for gap 108 can be used, such as just in cavity 102(1) or 102(2).

In this embodiment, the spacer 92(1) may include protrusions 110 in its second through-hole 106(1) that make contact with the inner portion of the front surface of the spacer 92(2) at its first through hole 106(1) the second through-hole 106(2) of the spacer 92(2) within the gap 108. The protrusions 110 may be used to maintain a desired spacing between the spacers 92(1)–92(2). Further, the protrusions 110 may be connected to the rear surface of the spacer 92(1) in an area in the gap 108 having the least potential for accumulating conductive material on the protrusions 110, although the protrusions 110 may be connected to the spacer support 96.

The operation of the lamp 30 having light emitting assembly 40(2) in this embodiment is the same as described above with respect to the lamp 30 having the light emitting assembly 40(1), but the thermoelectrons pass through the cavity 102(1) in spacer 92(1), an opening in spacer support 96 and the cavity 102(2) in spacer 92(2) before they are received by the anode 42.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A lamp comprising:

an anode oriented substantially towards a cathode in an envelope;

a baffle in the envelope located between the anode and the cathode, the baffle having an aperture; and an electrical insulator having a first surface connected to a first surface of the baffle and a second surface of the electrical insulator connected to a first surface of the anode, the electrical insulator having a transverse cavity extending from a first through-hole in the first surface of the electrical insulator to a second through-hole in the second surface of the electrical insulator, the electrical insulator having a gap in the transverse cavity, wherein one or more surfaces of the transverse cavity forming the gap are detached from the anode and the baffle.

2. The lamp as set forth in claim 1 wherein the gap is located adjacent the second through-hole in the electrical insulator.

3. The lamp as set forth in claim 1 wherein at least one of the surfaces of the transverse cavity forming the gap that is closest to the first through-hole is spaced away from the first through-hole by a portion of the transverse cavity.

4. The lamp as set forth in claim 1 wherein the gap extends substantially around the transverse cavity.

5. The lamp as set forth in claim 1 wherein the anode is connected to a radiator.

6. The lamp as set forth in claim 1 wherein the cathode is substantially coated with an electron emitting material.

7. The lamp as set forth in claim 1 wherein the electrical insulator comprises a ceramic material.

8. The lamp as set forth in claim 1 further comprising a cathode shield substantially covering the cathode, the cathode shield connected to a light emitting assembly at a window shield portion and made of a Nickel material.

9. The lamp as set forth in claim 1 further comprising an anode shield substantially covering the anode, the anode shield connected to a light emitting assembly at a support bracket portion and made of a Nickel material.

10. The lamp as set fort in claim 1 wherein the gap is located adjacent the first through-hole in the electrical insulator.

11. The lamp as set forth in claim 1 wherein at least one of the surfaces of the transverse cavity forming the gap that is closest to the second through-hole is spaced away from the second through-hole by a portion of the transverse cavity.

12. The lamp as set forth in claim 1 wherein at least one of the surfaces of the transverse cavity forming the gap that is closest to the first through-hole is spaced away from the first through-hole by a portion of the transverse cavity, and at least another one of the surfaces of the transverse cavity forming the gap that is closest to the second through-hole is spaced away from the second through-hole by another portion of the transverse cavity.

13. A lamp comprising:

an anode oriented substantially towards a cathode in an envelope;

a baffle in the envelope located between the anode and the cathode, the baffle having an aperture;

a first electrical insulator having a first surface connected to a first surface of the baffle, the first electrical insulator having a first transverse cavity extending from a first through-hole in the first surface of the first electrical insulator to a second through-hole in a second surface of the first electrical insulator, a second electrical insulator having a first surface connected to the second surface of the first electrical insulator and a second surface of the second electrical insulator connected to a first surface of the anode, the second electrical insulator having a second transverse cavity extending from a third through-hole in the first surface of the second electrical insulator to a fourth through-hole in the second surface of the second electrical insulator; and a gap formed in at least one of the first transverse cavity adjacent the second through-hole and the second transverse cavity adjacent the third through hole.

14. The lamp as set forth in claim 13 wherein the anode is connected to a radiator.

15. The lamp as set forth in claim 13 wherein the cathode is substantially coated with an electron emitting material.

16. The lamp as set forth in claim 13 wherein the electrical insulator comprises a ceramic material.

17. The lamp as set forth in claim 13 further comprising a cathode shield substantially covering the cathode, the cathode shield connected to a light emitting assembly at a window shield portion and made of a Nickel material.

18. The lamp as set forth in claim 13 further comprising an anode shield substantially covering the anode, the anode shield connected to a light emitting assembly at a support bracket portion and made of a Nickel material.

19. The lamp as set forth in claim 13 further comprising a support member being interposed between the first electrical insulator and the second electrical insulator.

20. The lamp as set forth in claim 13 further comprising at least one protrusion being interposed in the gap between the first electrical insulator and the second electrical insulator at a location having a low potential for accumulating conductive materials, the at least one protrusion connected to the first electrical insulator, the second electrical insulator or a support plate portion of a light emitting assembly.

21. The lamp as set forth in claim 13 wherein the gap is spaced in from the first and second through-holes in the first electrical insulator, or from the third and fourth through-holes in the second electrical insulator.

22. The lamp as set forth in claim 13 wherein the gap extends substantially around the first transverse cavity or the second transverse cavity.

23. The lamp as set forth in claim 13 wherein a portion of the gap is in both the first and second transverse cavity.

* * * * *